US005189748A

United States Patent [19]

Garrison et al.

[11] Patent Number: 5,189,748

[45] Date of Patent: Mar. 2, 1993

[54] INFANT SIDE SUPPORT SLEEPER

[76] Inventors: Tina A. Garrison; Susan A. Reichert, both of 2525 Octavia La., Marietta, both of Ga. 30062

[21] Appl. No.: 915,901

[22] Filed: Jul. 17, 1992

[51] Int. Cl.[5] ..... A47D 7/00; A47D 13/00

[52] U.S. Cl. ..... 5/655; 5/603; 5/632

[58] Field of Search ..... 5/655, 603, 632, 630, 5/490, 482, 424

[56] References Cited

U.S. PATENT DOCUMENTS

| | | | |
|---|---|---|---|
| 3,924,282 | 12/1975 | Bond | 5/632 |
| 4,030,719 | 6/1977 | Gabriele et al. | 5/655 |
| 4,383,713 | 5/1983 | Roston | 5/655 |
| 4,434,513 | 3/1984 | Welch | 2/410 |
| 4,441,221 | 4/1984 | Enste et al. | 5/655 |
| 4,584,730 | 4/1986 | Rajan | 5/632 |
| 4,648,142 | 3/1989 | Bruning | 5/93.1 |
| 4,733,836 | 5/1988 | Barnes | 5/655 |
| 4,744,117 | 5/1988 | Bond | 5/630 |
| 4,771,493 | 9/1988 | Park | 5/603 |
| 4,783,865 | 11/1988 | Stotler | 5/424 |
| 4,788,726 | 12/1988 | Rafalko | 5/93.1 |
| 4,958,393 | 9/1990 | Brecher | 5/603 |
| 5,056,533 | 10/1991 | Solano | 5/655 |

FOREIGN PATENT DOCUMENTS

| | | | |
|---|---|---|---|
| 1449012 | 7/1966 | France | 5/655 |

*Primary Examiner*—Alexander Grosz

[57] ABSTRACT

A device to comfortably keep an infant on its side while sleeping. The infant side support sleeper (shown in FIG. 3) is comprised of a back support (25) and stomach support (26) attached with material (11) in which an infant is laid on its side in between the two supports in order to keep the infant in a stationary position on its side.

1 Claim, 4 Drawing Sheets

INFANT SIDE SUPPORT SLEEPER

BACKGROUND

1. Field of Invention

This invention relates to infant restraining devices, specifically to a restraining device to keep an infant remaining on its side while sleeping.

2. Description of Prior Art

In May of 1992, the American Pediatric Association published a study stating that infants who slept on their sides were at less of a risk of dying from Sudden Infant Death Syndrome than infants who slept on their stomachs. There is no conventional method of supporting an infant on his side other than rolling up a blanket and placing it behind his back. This method of supporting an infant on his back is unsatisfactory because of the lack of reliable support from a blanket which may unroll.

Most users, therefore, would find it desirable to have a device which would reliably and comfortably keep an infant on its side while it is sleeping.

All research indicates that the infant side support sleeper is a completely unique invention and that there is no prior art directly germane to this invention.

This invention solves the problem of keeping an infant remaining comfortably on its side while it is sleeping.

SUMMARY OF THE INVENTION

Accordingly it is an object of this invention to provide a device that reliably keeps an infant on its side while sleeping.

To provide an easily usable, durable and washable device.

To provide a device that is adjustable for different size infants.

To provide a device that is safe to use.

To provide a device in which an infant can be laid on either side.

To provide a device that is portable.

Other objects and advantages of the invention will become apparent from a consideration of the ensuring description and the accompanying drawings.

DRAWING FIGURES

DRAWING REFERENCE NUMERALS

Figure 1:
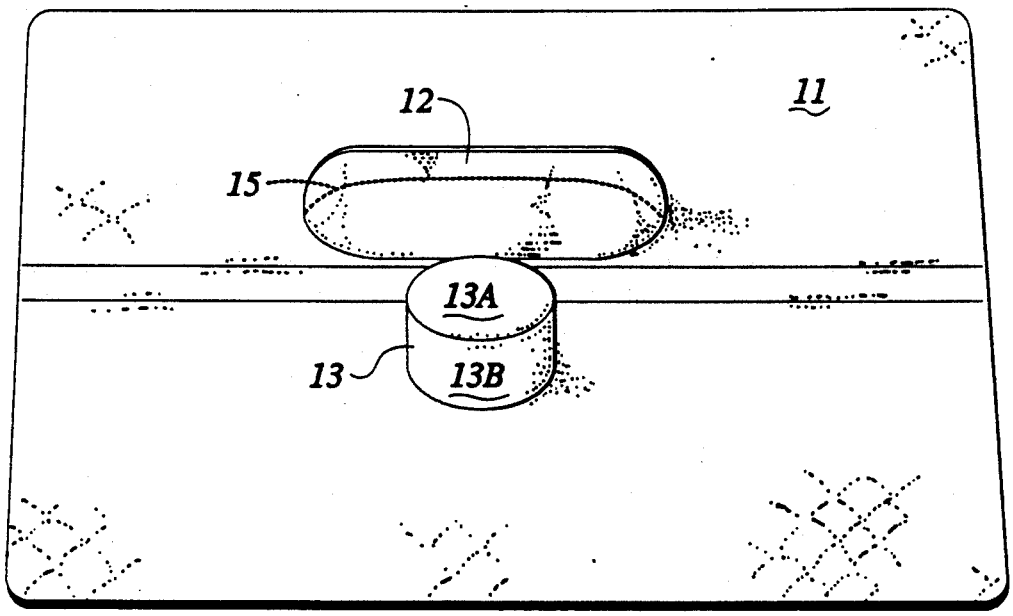
FIG. 1 shows the plan view of the side sleeper without a baby.

10 tucks
11 fabric base

12 pillow casing—outer most fabric that covers the pillow insert.
12A pillow casing pattern
13 post casing—outer most fabric that covers the post insert.
13A pattern for post top casing
13B pattern for post side of casing
15 pattern for underside of pillow casing
16 pillow insert—foam or fiber stuffing covered by waterproof fabric.
16A pattern for pillow insert bottom cover
16B pattern for pillow insert top cover
17 pattern for underside of post casing
18 post insert—foam or fiber stuffing covered by waterproof fabric.
18A pattern for post insert top cover
18B pattern for post insert side cover
20 post pattern hole sizing
21 pillow pattern hole sizing
22 post hole
23 pillow hole
24 infant
25 finished pillow including all parts (pillow casing, pillow insert and foam or fiber stuffing)
26 finished post including all parts (post casing, post insert, and foam or fiber stuffing)
27 crib sheet
28 illustration of solid closing
29 illustration of zipper closing
30 illustration of hook and loop type fastener, such as the one sold under the Trademark of Velcro.
31 illustration of snaps closing
32 illustration of hooks and eye closing

DESCRIPTION OF THE PREFERRED EMBODIMENTS

Figure 3:
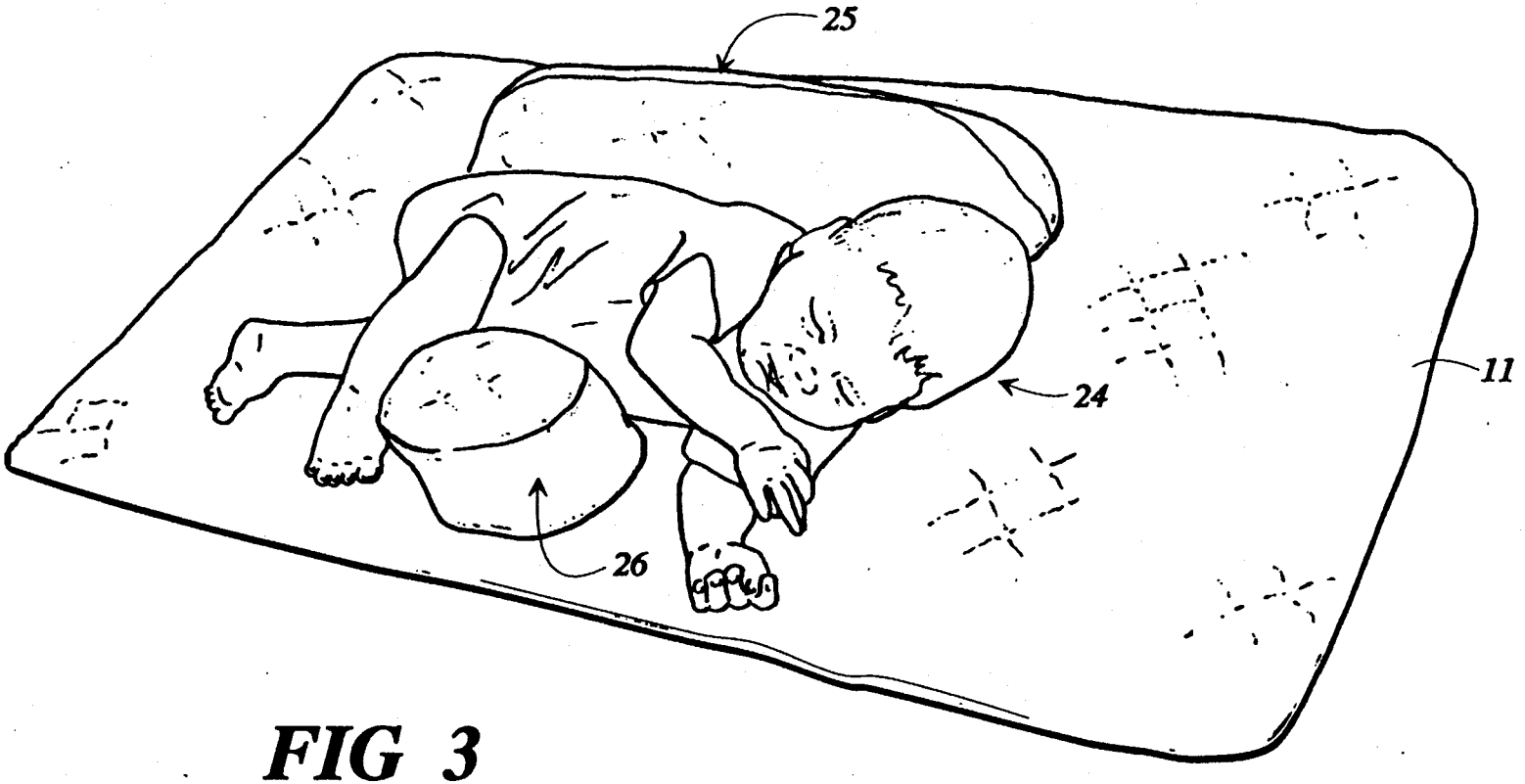
FIG. 3 is a perspective illustration of the infant side sleeper with a baby in place.

FIG. 3 shows an infant 24 sleeping in place on his side with a larger elongated pillow 25 supporting his back and a smaller, laterally spaced post 36 supporting him from the front.

The side sleeper is composed of a large planar fabric sheet base 11 (FIG. 1) that connects and supports in place a pillow casing 12 (FIG. 1) and a post casing 13 (FIG. 1). The pillow and post casings 12 and 13 would each be stuffed with a foam or fiber filling or insert to make a solid support for the infant. The foam or fiber filling or insert for the pillow and the post are covered by waterproof fabric shown by pattern parts 16A and 16B (FIG. 5) for the pillow, and 18A and 18B for the post. This waterproof fabric used to cover the foam or fiber stuffing protects the stuffing from any moisture and allows the pillow insert 16 (FIG. 2) and post insert 18 (FIG. 2) to be removed when the fabric base 11, pillow casing 12 and post casing 13 are soiled. Openings in the bottom of the pillow casing 15 (FIG. 2) and post casing 17 (FIG. 2) will allow for the pillow insert 16 and post insert 18 to be easily removed and reinserted in casings 12 and 13.

The pillow 25 can be made of various sizes for different ages of infants. The pillow 12 in FIG. 1 is sized for a small infant but can be made larger or smaller by adding inches to the length and width of all pattern parts. The pillow 12 in FIG. 1 is sized for a small baby but can be made larger or smaller by adding inches to the length and width of all pattern parts. The post 13 is an oval shape support designed to support the baby from the front in order to keep him snug but comfortably in place on his side.

The post 13 can also be made larger or smaller by adding inches to the length or width of all pattern parts.

Figure 2:
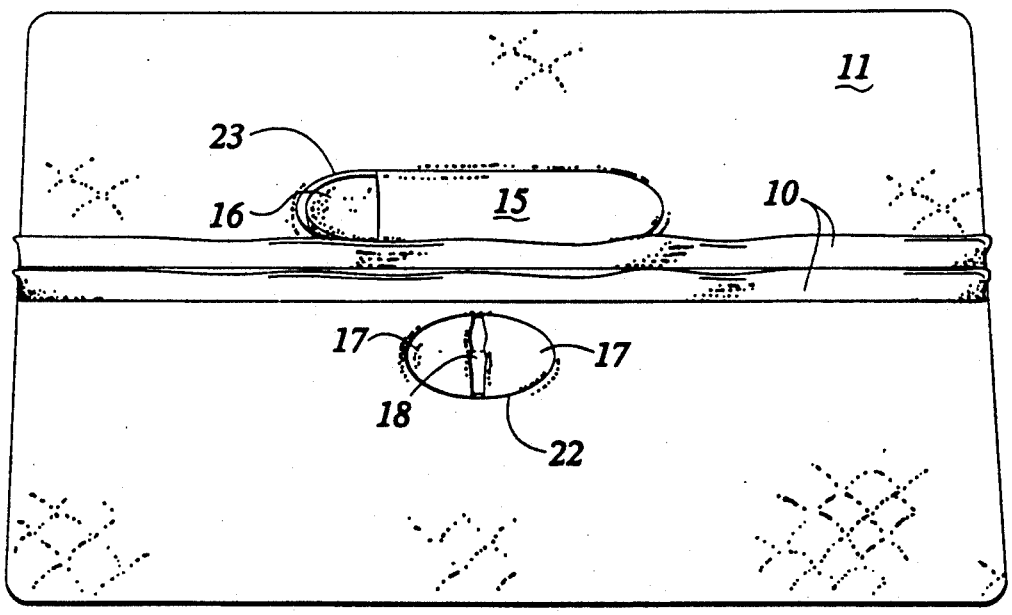
FIG. 2 shows a view of the underside of the sleeper including the pillow and post inserts and the underside casing fabric that holds the inserts in place.

FIG. 2 shows the underside of the fabric base with pillow insert 16 inserted into the underside bottom pillow casing 15, and the post insert 18 inserted into the underside bottom post casing 17.

Figure 4:
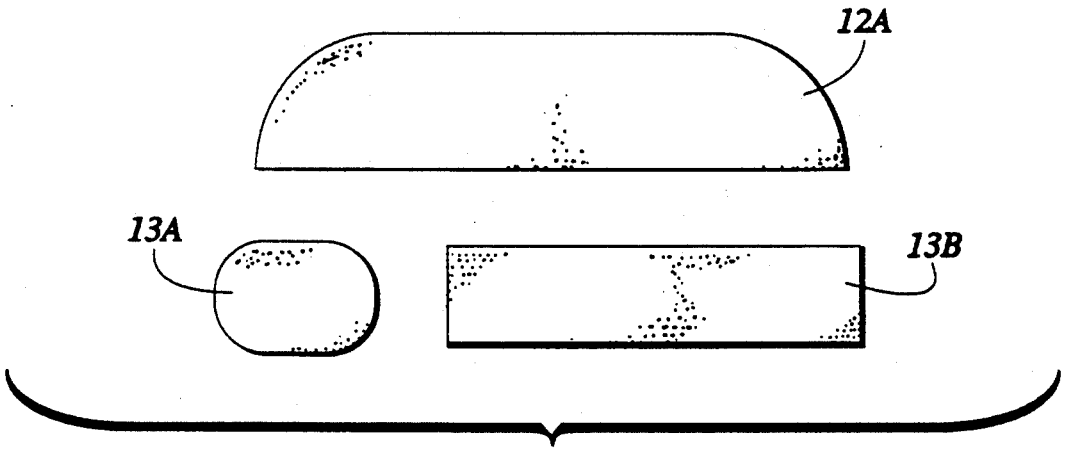
FIG. 4 shows the patterns for making the top of the sleeper pillow and post casings.

FIG. 4 shows the pattern for making the top pillow case of the sleeper which consists of cutting out two fabric pieces of 12A. The two fabric pieces of pillow case 12A are stitched together across the top and then stitched to the cut out hole 23 in the fabric 11 around the bottom of pillow case 12A forming a pocket. Fabric pieces 13A and 13B are stitched together to form post case 13 which is stitched into hole 22 at the bottom to the fabric base 11.

Figure 5:
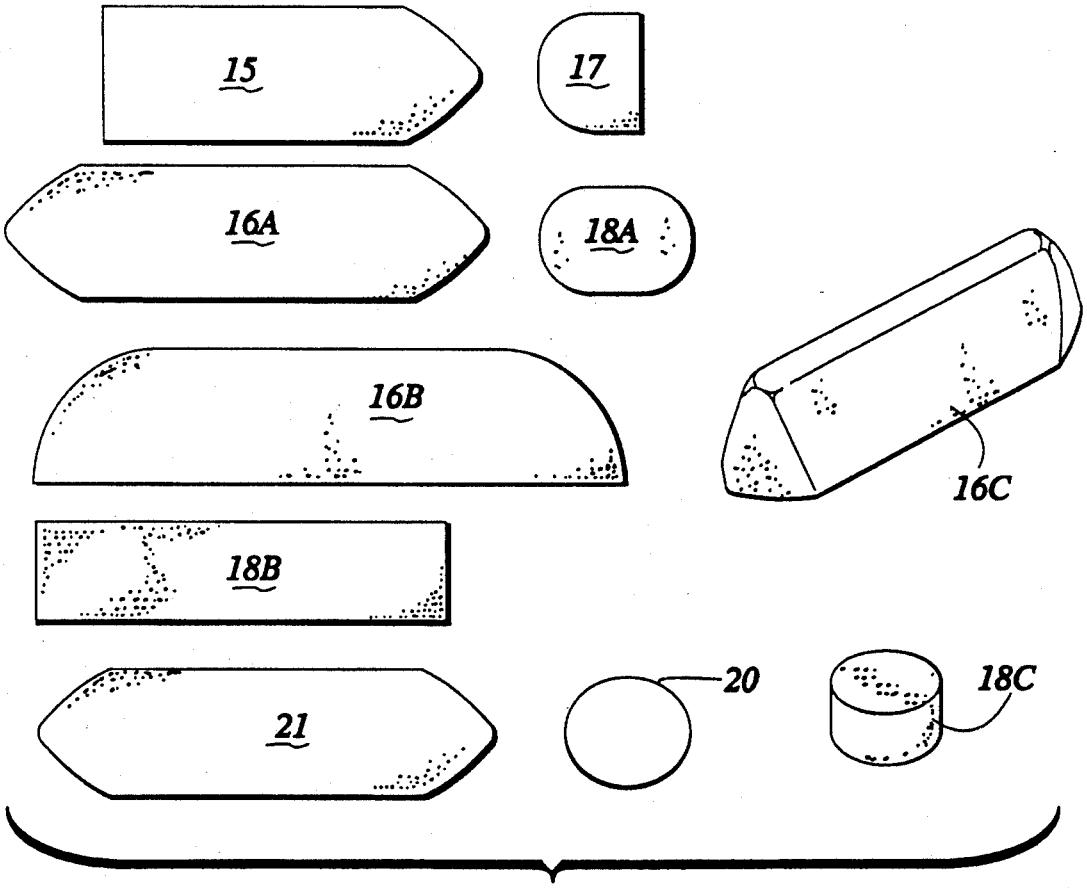
FIG. 5 shows the pattern for making the sleeper pillow insert, the post insert, the underside of the pillow and post casing and the hole sizing.

FIG. 5 shows making the pillow insert cover using three pieces of fabric, two pieces of 16B and one piece of 16A, of a water proof fabric to cover foam or other filler needed for stuffing pillow insert 16. Making post insert cover involves using three pieces of water proof material, two pieces of 18A and one piece of 18B, stitching them together and then filling it with the foam or filler in order to make a firm but soft post insert 18. The pillow insert 16 and post insert 18 are now ready to be inserted into casings through the casing openings 15 and 17 shown in FIG. 2. Pattern pieces 17 and 15 are the patterns for the underside of the pillow and post casing used to hold post insert 18 and pillow insert 16 in place as shown in FIG. 2. The post insert 16 and pillow insert 18 are meant to be removable for easy washing.

Figure 6A:
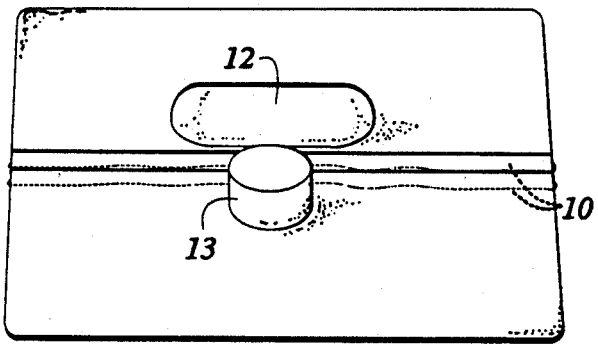
FIG. 6A shows the tucks in the sleeper.
Figure 6B:
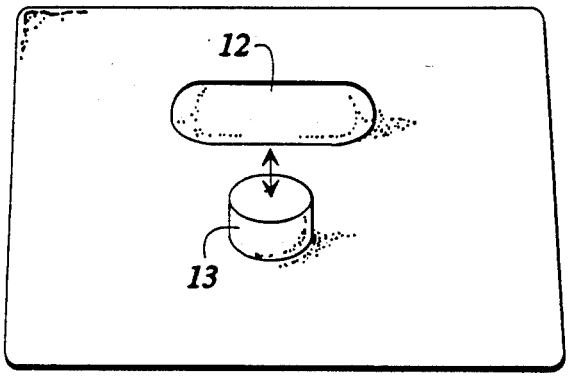
FIG. 6B shows the sleeper with tucks expanded.

FIG. 6 shows the portable sleeper can be made with one or more tucks 10 between pillow 12 and post 13 to be let out as baby grows older and bigger. FIG. 6A shows the sleeper with the tucks 10 untucked.

Figure 7:
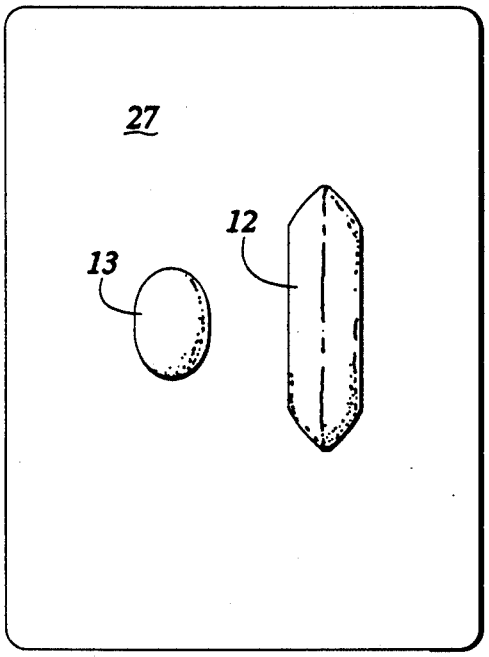
FIG. 7 shows a crib sheet with side sleeper built into it.

FIG. 7 shows a baby's crib sheet 27 can also be made into a side sleeper as well as the flat portable fabric FIG. 1.

Figure 8:
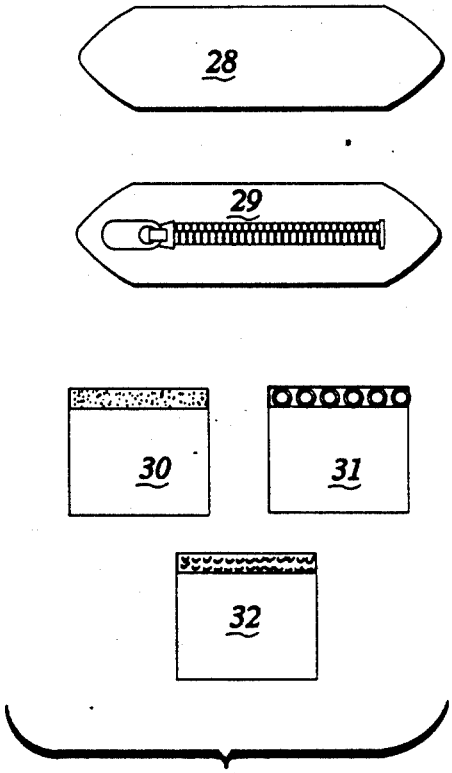
FIG. 8 shows variations of types of closing that may be used to keep pillow inserts in place.

FIG. 8 shows various types of closings may be used to keep pillow insert 16 and post insert 18 in place. Hook or loop tipped tab 30, the zipper 29, snaps 31, a solid covering for a permanent closing 28 and a hooks and eye closing 32.

Infant Side Sleeper—Operation

The function of the infant side sleeper is to hold an infant comfortably but securely on its side while it is sleeping. A parent would simply lie an infant on its side in between the pillow 25 and post 26, which would comfortably secure the infant on its side FIG. 3. The infant would face the post 26, with that post resting against its stomach and his back would be supported by the pillow 25. A parent can place the infant on either of the infants sides to prevent the infant from becoming sore if left on one side for a period of time.

The function of each of the parts of the side sleeper are as follows: pillow 25 is used to aid in supporting an infant on its side and restricting a child from rolling over onto its back while sleeping, post 26 is also used to support the child on its side by holding him at his stomach, the infant would be on its side in between pillow 25 and post 26, the fabric base 11 that the pillows are attached to serves to space the pillow 25 and post 26 and to support them in position while allowing for a soft substance in which the infant can lay. The tuck 10 is used to allow an adult to increase the width of the space in between the pillow 25 and the post 26 as a child gets bigger. The openings in the underside of the pillow casing 15 and post casing 17 serve the function of allowing pillow insert 16 and post insert 18 to be removed so when the fabric above them becomes soiled that material may be washed without harming either the pillow or the post inserts.

While the above description contains many specificities, the reader should not construe these as limitations on the scope of the invention, but merely as exemplifications of preferred embodiments thereof. Those skilled in the art will envision that many other possible variations are within its scope.

For example, skilled artisans will readily be able to change the dimensions and shapes of the various embodiments. They will also be able to make the pillow inserts out of alternative materials, design various other methods of making the pads removable, and changing the shape of either the pillow or the post inserts. Accordingly the reader is requested to determine the scope of the invention by the appended claims and their legal equivalents, and not by the examples which have been given.

We claim:

1. A restraining device adapted to support an infant lying on its side comprising a planar fabric sheet of a sufficient size to support the full length of the infant;

a larger elongated pillow casing member and a smaller laterally spaced post casing member attached to the upper side of said sheet, closeable opening means located on the lower side of said sheet, permitting the positioning and removal of pillow insert in the pillow casing and a post insert in the post casing;

pillow and post inserts positioned in the pillow and post casings respectively, said pillow insert adapted to support substantially the whole back portion of an infant lying on its side, and the post insert adapted to support the abdominal area of the infant while permitting substantial movement of the hands and feet of the infant, whereby an infant positioned on its side on said sheet will be restrained on its side with its back contacting the pillow casing and its front contacting the post casing.

* * * * *